US005298704A

United States Patent [19]

Opfer et al.

[11] Patent Number: 5,298,704

[45] Date of Patent: Mar. 29, 1994

[54] CONTACT OPERATING ARRANGEMENT WITH SHOCK-REDUCING FEATURE FOR HIGH-VOLTAGE APPARATUS

[75] Inventors: John C. Opfer, Chicago; Henry W. Kowalyshen, Niles, both of Ill.

[73] Assignee: S&C Electric Company, Chicago, Ill.

[21] Appl. No.: 990,869

[22] Filed: Dec. 16, 1992

[51] Int. Cl.[5] ..... H01H 33/42

[52] U.S. Cl. ..... 200/148 F; 200/148 A

[58] Field of Search ..... 200/148 R, 148 A, 148 B, 200/148 F, 144 R

[56] References Cited

U.S. PATENT DOCUMENTS

| | | | |
|---|---|---|---|
| 3,674,956 | 7/1972 | Erni | 200/148 A |
| 3,745,283 | 7/1973 | Bischofberger et al. | 200/148 R |
| 3,889,084 | 6/1975 | Kucharski | 200/148 R |
| 3,943,314 | 3/1976 | Frink | 200/148 A |
| 4,000,387 | 12/1976 | Milianowicz | 200/148 A |
| 4,090,051 | 5/1978 | Frink et al. | 200/144 R |
| 4,568,806 | 2/1986 | Frink | 200/148 A |
| 4,668,848 | 5/1987 | Kowalyshen et al. | 200/248 |
| 4,788,390 | 11/1988 | Crino | 200/148 A X |

*Primary Examiner*—J. R. Scott

*Attorney, Agent, or Firm*—James V. Lapacek

[57] ABSTRACT

Contact operating arrangement utilizing a stroke multiplier mechanism is provided for operating the contacts of high-voltage apparatus. The contact operating arrangement includes a shock-reducing feature such that the loading and forces on the stroke multiplier mechanism caused by the rapid deceleration of the moving contact structure are reduced by transfer to other portions of the contact operating arrangement. Where desired, the contact operating arrangement also includes provisions to reduce the loading to the moving contact structure during contact opening.

8 Claims, 2 Drawing Sheets

CONTACT OPERATING ARRANGEMENT WITH SHOCK-REDUCING FEATURE FOR HIGH-VOLTAGE APPARATUS

BACKGROUND OF THE INVENTION

1. Field of the Invention

The present invention relates generally to the field of high-voltage apparatus and more particularly to an arrangement with shock-reducing features for a stroke multiplier that is utilized to operate a moving contact of high-voltage apparatus.

2. Description of the Related Art

Various contact operating arrangements are known for high-voltage apparatus. For example, arrangements are shown in U.S. Pat. Nos. 4,668,848, 4,000,387, 3,889,084 and 3,745,283. In particular, the arrangement in the '387 patent includes a lazy-tong-multiplying operating which is one form of a type of mechanism known as a stroke multiplier. The stroke multiplier is useful to increase the speed of contact operation, which is desirable to minimize arcing when opening or closing the contacts of high-voltage circuit interrupters. The stroke multiplier also increases the length of the stroke (distance of contact travel) with respect to the drive mechanism travel which permits a smaller drive mechanism. While the arrangement of the '387 patent may be generally useful for its intended purpose, the stroke multiplier absorbs all of the impact load on contact opening due to the rapid deceleration of the rapidly moving portions of the operator. For example, when the contacts are opened, as the stroke multiplier comes to the end of its opening stroke, the moving parts of the contact operating mechanism impact the stroke multiplier. While such impact forces are always undesirable, this is especially a problem for a stroke multiplier. Additionally, to accommodate these impact forces, the mass of the stroke multiplier must increase, which is undesirable for both space considerations and the most efficient and rapid operation.

SUMMARY OF THE INVENTION

Accordingly, it is a principal object of the present invention to provide a contact operating arrangement that utilizes a stroke multiplier with shock-reducing features. ap This and other objects of the present invention are efficiently achieved by a stroke multiplier for operating the contacts of high-voltage apparatus. The arrangement includes a shock-reducing feature such that the loading and forces on the stroke multiplier caused by the rapid deceleration of the moving contact structure are reduced by transfer to other portions of the arrangement. Where desired, the arrangement also includes provision to reduce the loading to the moving contact structure during contact opening.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
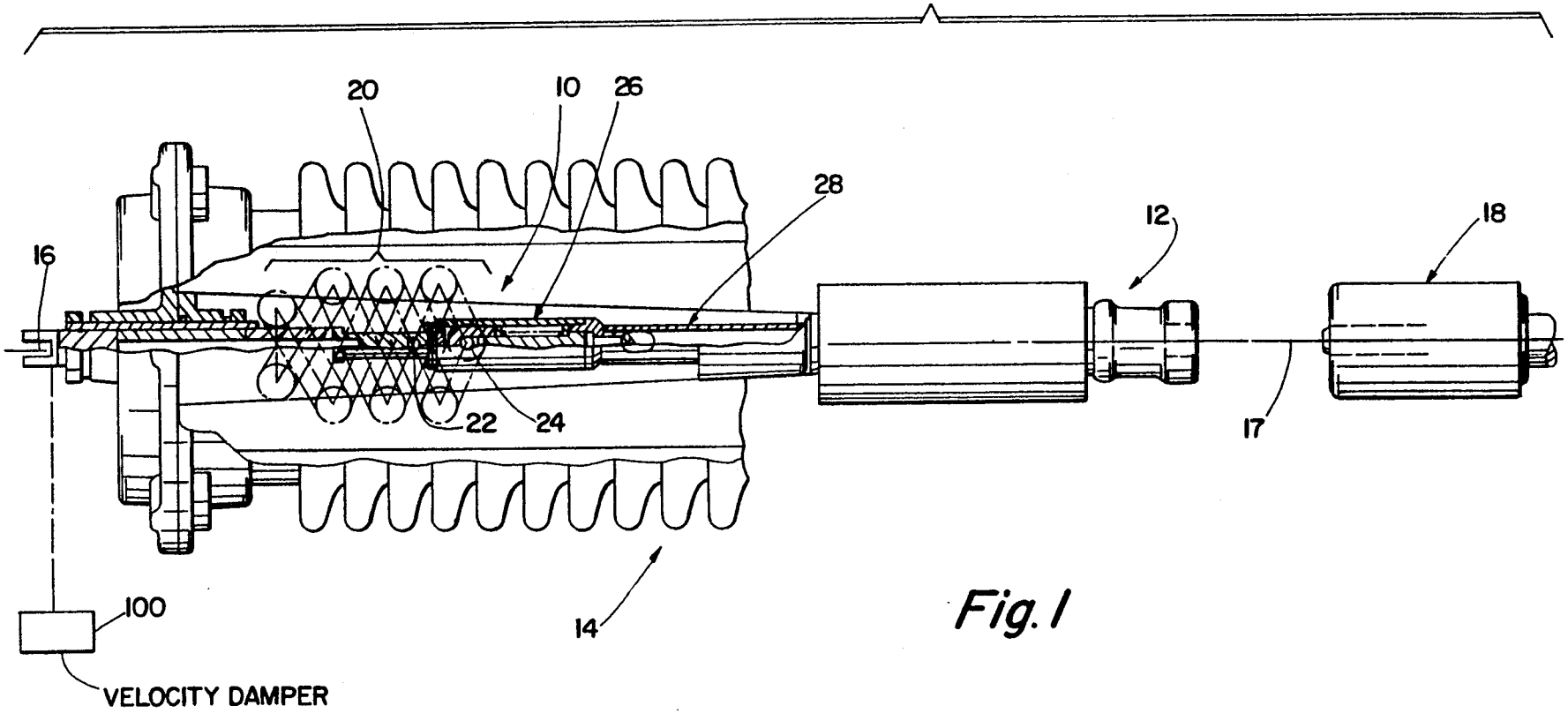
FIG. 1 is an elevational view, partly in section, of the contact operating arrangement of the present invention illustrating a typical application with a circuit interrupter.

Referring now to FIG. 1, the contact operating arrangement 10 of the present invention is illustrated to operate the moving contact structure 12 of an interrupter 14. However, it should be understood that the contact operating arrangement 10 is also useful for various other apparatus. Thus, the description in conjunction with the interrupter 14 should not be interpreted in any limiting sense. The interrupter 14 is operated via movement of an input member 16 to move the moving contact structure 12 with respect to a stationary contact structure 18 generally along an axis 17. The input member 16 is arranged to drive a stroke multiplier 20 of the contact operating arrangement 10 via an input pin 22 that passes through the input member 16 and the stroke multiplier 20. An output pin 24 is positioned through the stroke multiplier 20 and a drive-coupling member 26. The drive-coupling member 26 is affixed to a moving contact tube 28 of the moving contact structure 12 to operate the contact structures 12 and 18 between two end positions, corresponding to open and closed positions in the illustrative arrangement.

Figure 2:
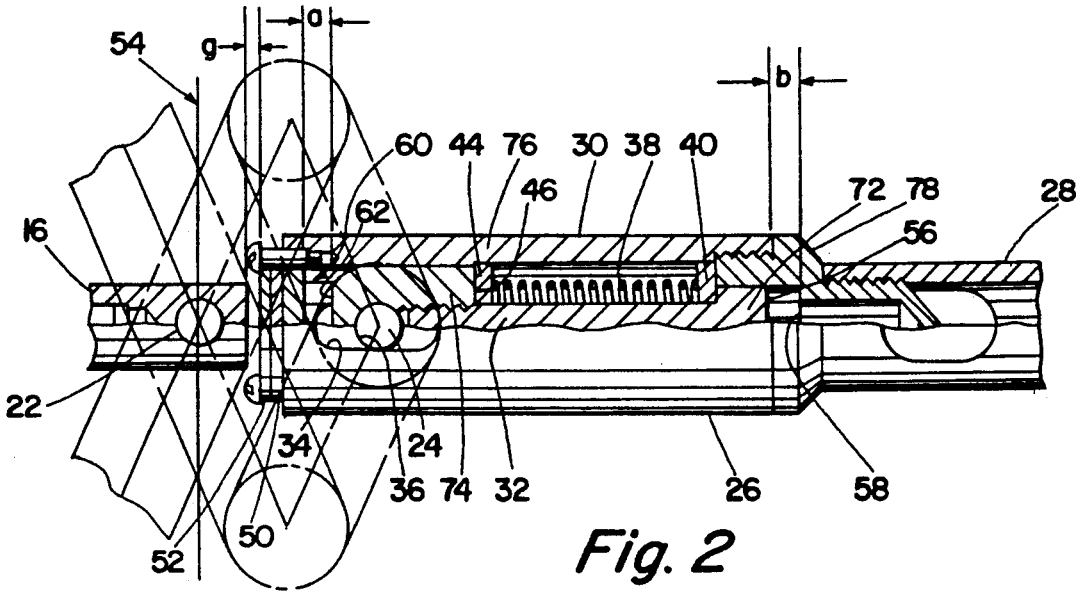
FIGS. 2–4 are enlarged views of portions of the arrangement of FIG. 1 illustrating three sequential positions during operation.
Figure 3:
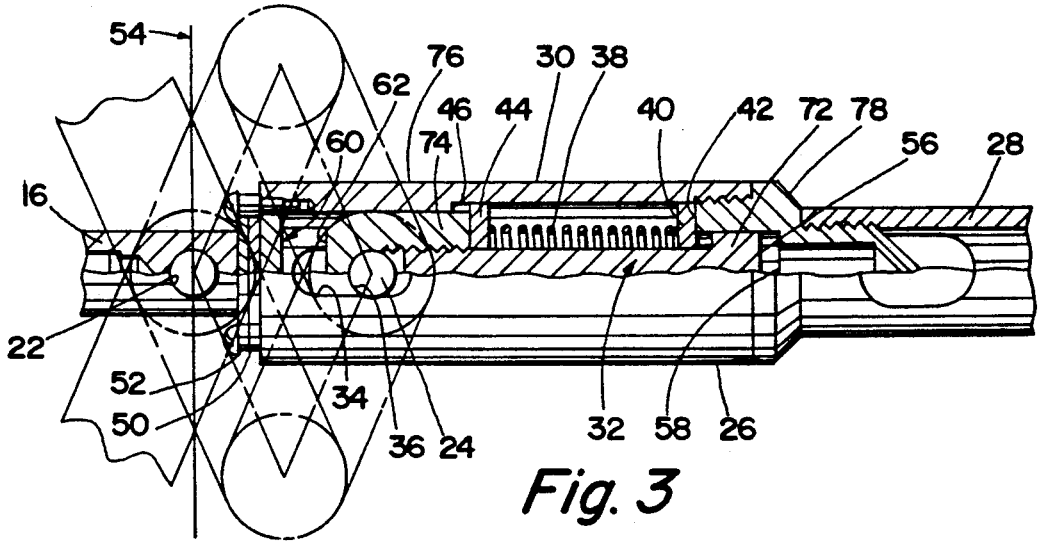
Figure 4:
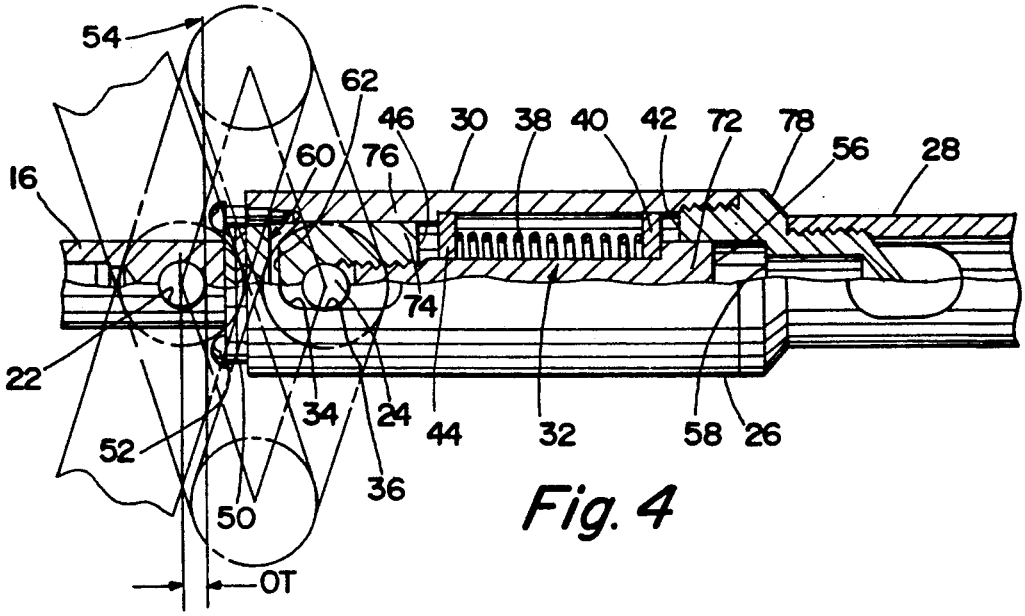

Referring now additionally to FIGS. 2–4, the drive-coupling member 26 of the contact operating arrangement 10 includes a carriage 30 that is generally hollow and a shuttle 32 that is carried within the carriage 30. The output pin 24 passes through slots 34 in the walls of the carriage 30. The slots 34 are dimensioned such that the output pin 24 can move relative to the carriage 30 over a predetermined range along the axis 17 for purposes as will be explained in more detail hereinafter. The output pin 24 also passes through the shuttle 32 via a passage 36. Thus, movement of the stroke multiplier 20 at the output pin 24 results in corresponding movement of the shuttle 32 along the axis 17. For a given distance of movement of the input member 16, the output pin 24 at the shuttle 32 moves "m" times that distance, where "m" is the stroke multiplication factor.

In the preferred embodiment, the contact operating arrangement 10 includes a spring 38 positioned between the shuttle 32 and the carriage 30 so as to provide resilient or shock-absorbing coupling between the stroke multiplier 20 and the moving contact structure 12 in either direction of movement. However, in other embodiments of the present invention, for applications where the moving contact structure is capable of withstanding the impact after lost motion occurs between the shuttle 32 and the carriage 30, the spring 38 is not required, such that the shuttle 32 includes a rigid portion 38 that is shorter than the spring 38 as illustrated in FIG. 2 to provide the predetermined range of relative motion between the shuttle 32 and the carriage 30 as defined hereinafter, e.g., approximately of the length illustrated in FIG. 3.

From the open contact position of FIGS. 1 and 2, as the input member 16 moves to the right along the axis 17, movement is transferred to the shuttle 32 via the stroke multiplier 20 and the output pin 24. As the shuttle 32 is moved to the right, force is transferred through the spring 38 to urge the carriage 30 to the right. Thus, as the input member 16 is moved to the right, the carriage 30 with the affixed moving contact structure 12 is driven toward the closed contact position. As can be best seen in FIG. 2, a surface 56 of the shuttle 32 and a surface 58 of the carriage 30 limit relatively rightward motion of the shuttle 32 with respect to the carriage 30 a distance denoted "b" for future reference. As can be best seen in FIGS. 3 and 4, a thrust washer 40 is positioned intermediate the spring 38 and the shuttle 32. Upon contact closing movement to the right in FIGS. 1 and 2, the thrust washer 40 contacts a portion 42 of the carriage 30 to transfer movement of the shuttle 32 to the carriage 30.

Upon contact opening, the input member 16 is moved to the left and the stroke multiplier 20 via the output pin 24 causes the carriage 30 to move to the left toward the open contact position of FIG. 1, the shuttle 32 pulling the carriage 30 to the left via the force transmitted through the spring 38. When the contacts are being opened, movement of the shuttle 30 is transferred through the spring 38 to the carriage 30 through a thrust washer 44 and a portion 46 of the carriage 30, as best seen in FIG. 3.

As can be seen in FIG. 2, the nominal open position is illustrated with a gap "g" between the drive-coupling member 26 and the input member 16. A resilient pad 50 and an impact plate 52 are provided on the left end of the carriage 30 adjacent the input member 16. The position in FIG. 2 corresponds to that of the open position of the input member 16 where a velocity damper (referred to generally at 100 in FIG. 1) such as a dash pot or rubber bumper (not shown) would begin to stop the movement of the input member 16 for leftward movement toward the reference line 54. A surface 60 of the carriage 30 and a surface 62 of the shuttle 32 limit relative leftward motion of the shuttle 32 with respect to the carriage 30 a distance denoted "a".

In the position of FIG. 2, the input member 16 can move a distance to the left "xf" equal to $g/(m-1)$ before any relative motion is required between the shuttle 32 and the carriage 30, assuming the input member 16 is moved slowly enough to prevent dynamic effects. Thus, this amount of movement occurs without compressing of the spring 38.

With reference to FIG. 3 and considering now what happens when the input member 16 is moving to the left but is being decelerated by the velocity damper 100, as the input member 16 moves to the left to a position left of the reference line 54 (the nominal open position of the input member 16), the input member 16 is then decelerated by the velocity damper (referred to generally at 100 in FIG. 1). When the input member 16 decelerates and essentially comes to a stop, the shuttle 32 by virtue of connection to the stroke multiplier 20 also comes to a stop. However, due to inertia, the moving contact structure 12 and the attached carriage 30 continue to move to the left. Accordingly, with the input member 16 stopped at the reference line 54, the carriage 30 moves to the left relative to the shuttle 32 over the distance "g" before the impact plate 52 contacts the input member 16. After contact, the carriage 30 continues moving a small distance as the resilient pad 50 is compressed (and deformed). At that point, the force required to decelerate the moving contact structure 12 and the carriage 30 is provided by the input member 16 and the associated velocity damper 100. Thus, it can be seen that the force on the stroke multiplier 20 due to the deceleration of the moving contact structure 12 and the carriage 30 is limited to that provided by the spring 38 as it compresses an amount essentially equal to "g". If the force on the stroke multiplier 20 is to be limited to that exerted by the spring 38, the maximum value for the distance "g" is "b".

With reference now to FIG. 4, although the carriage 30 is decelerated by the velocity damper 100 through the input member 16, as the carriage 30 continues to move past the position shown in FIG. 3, the input member 16 is moved to the left of the reference line 54. The carriage 30 maintains contact with the input member 16 but the shuttle 32 is now moving to the left relative to the carriage 30. As the shuttle 32 moves relative to the carriage 30, the relative positions of FIG. 4 are achieved. As a result of the compression of the spring 38, the leftward acting force on the stroke multiplier 20 decreases to zero and begins increasing in the opposite direction. The input member 16 continues moving to the left from FIG. 3 to FIG. 4 until it is finally stopped by the velocity damper at a position designated by the distance "OT" to the left of the reference position 54. In that position, the spring 38 has been compressed an amount equal to the product of "OT" and $(m-1)$. The maximum value for the distance of overtravel "OT" is equal to $a/(m-1)$, if the force on the stroke multiplier 20 is to be limited to that exerted by the spring 38. Thus, it can be seen that the carriage 30 touches the input member 16 so as to be able to transfer the impact load directly to the input member 16 while still allowing relative movement between the output pin 24 and the input pin 22. Additionally, the shock loading to the moving contact structure 12 is also reduced. After the position of FIG. 4, the system returns to the nominal open position of FIG. 2.

Considering now the structural details of a specific embodiment of the drive-coupling member 26, the shuttle 32 includes a shuttle pin 72 that is affixed to a shuttle body 74. The carriage 30 includes a generally hollow body portion 76 and an adapter 78 that is affixed to the body portion 76. The adapter 78 is threadingly attached to the moving contact tube 28.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A moving contact operating mechanism for driving a moving contact member comprising:

an input member;

an output member connected to the moving contact member; and driving means coupled between said input member and said output member for driving said output member in a first, contact-closing direction and a second, contact-opening direction, said driving means comprising a stroke multiplier mechanism and coupling means for coupling said stroke multiplier mechanism to said output member, said coupling means comprising means for transmitting movement of said stroke multiplier to said output member and for limiting forces transmitted from said output member to said stroke multiplier mechanism.

2. The moving contact operating mechanism of claim 1 wherein said output member and said coupling means further comprise means for providing a predetermined range of relative movement between said stroke multiplier mechanism and said output member.

3. The moving contact operating mechanism of claim 2 wherein said movement transmitting means comprises resilient means.

4. The moving contact operating mechanism of claim 3 wherein said coupling means further comprises a first member, said resilient means being disposed between said first member and said output member whereby forces on said first member are transmitted through said resilient means to said output member.

5. The moving contact operating mechanism of claim 4 wherein said output member and said movement transmitting means further comprises inter-engaging means for transferring movement of said first member to said output member via said resilient means in each of said contact closing and contact opening directions and for transferring movement of said output member to said first member in each of said contact closing and contact opening directions.

6. The moving contact operating mechanism of claim 1 wherein said input member and said output member comprise cooperating means for causing said output member to engage said input member at a predetermined position of said input member.

7. In high-voltage apparatus having a moving contact operating mechanism including an input member, an output member connected to a moving contact member, and a stroke multiplier mechanism coupled between the input member and the output member, the provision of means coupled between the stroke multiplier mechanism and the output member for driving the output member through the stroke multiplier mechanism and for limiting the forces transmitted from the output member to the stroke multiplier mechanism.

8. A moving contact operating mechanism for driving a moving contact member comprising:

an input member;

an output member connected to the moving contact member; and driving means coupled between said input member and said output member for driving said output member in a first, contact-closing direction and a second, contact-opening direction, said driving means comprising a stroke multiplier mechanism and coupling means for coupling said stroke multiplier mechanism to said output member, said input member and said output member comprising cooperating means for causing said output member to engage said input member at a predetermined position of said input member.

* * * * *